US007136613B2

(12) United States Patent
Sato et al.

(10) Patent No.: US 7,136,613 B2
(45) Date of Patent: Nov. 14, 2006

(54) MULTICOLOR IMAGE FORMING APPARATUS AND IMAGE MAKING DEVICE

(75) Inventors: Shougo Sato, Seto (JP); Katsuyuki Yokoi, Iwakura (JP); Masashi Suzuki, Nagoya (JP); Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 16 days.

(21) Appl. No.: 10/795,382

(22) Filed: Mar. 9, 2004

(65) Prior Publication Data

US 2004/0234301 A1 Nov. 25, 2004

(30) Foreign Application Priority Data

Mar. 10, 2003 (JP) ..... 2003-064137
Mar. 24, 2003 (JP) ..... 2003-080851

(51) Int. Cl.
*G03G 15/01* (2006.01)
*G03G 21/20* (2006.01)

(52) U.S. Cl. ..... 399/299; 399/92; 399/302

(58) Field of Classification Search ..... 399/299, 399/101, 297, 302
See application file for complete search history.

(56) References Cited

U.S. PATENT DOCUMENTS 4,371,253 A * 2/1983 Day et al. ..... 399/179
5,012,290 A * 4/1991 Berkes et al. ..... 399/162
5,027,158 A * 6/1991 Tompkins et al. ..... 399/162
5,313,259 A * 5/1994 Smith ..... 399/76
5,493,371 A * 2/1996 Kutsuwada et al. ..... 399/88
5,541,718 A * 7/1996 Oono ..... 399/297
5,583,629 A * 12/1996 Brewington et al. ..... 399/302
5,666,599 A * 9/1997 Miyasaka et al. ..... 399/162
5,815,775 A * 9/1998 Miyasaka et al. ..... 399/162
6,088,565 A * 7/2000 Jia et al. ..... 399/302
6,381,428 B1 4/2002 Yamamoto et al. ..... 399/116
6,405,002 B1 * 6/2002 Ogiyama et al. ..... 399/101
6,445,899 B1 * 9/2002 Sato ..... 399/284
6,516,176 B1 * 2/2003 Yoshida ..... 399/302
6,597,886 B1 * 7/2003 Yoshida ..... 399/302
6,604,461 B1 * 8/2003 De Bock et al. ..... 101/211
6,621,554 B1 9/2003 Ayash et al.
6,633,733 B1 * 10/2003 Mochimaru et al. ..... 399/45
6,690,898 B1 * 2/2004 Nishiwaki ..... 399/101
6,760,562 B1 * 7/2004 Nishida et al. ..... 399/297
6,801,742 B1 * 10/2004 Mochimaru et al. ..... 399/309
2002/0172527 A1 11/2002 Nishiwaki et al.

FOREIGN PATENT DOCUMENTS

JP A 7-140884 6/1995

(Continued)

*Primary Examiner*—Diego Gutierrez
*Assistant Examiner*—Amy R. Cohen
(74) *Attorney, Agent, or Firm*—Oliff & Berridge, PLC

(57) ABSTRACT

An image forming apparatus, includes: a plurality of image carriers each carrying a developer image; a primary transfer belt opposed to the plurality of image carriers and configured to carry a multicolor developer image; a secondary transfer unit opposed to the primary transfer belt and configured to transfer the multicolor developer image carried on the primary transfer belt onto a transfer medium; and a fixing unit configured to fix the multicolor developer image transferred by the secondary transfer unit on the transfer medium. The primary transfer belt is provided along a substantial vertical direction. The secondary transfer unit is provided on the opposite side of the image carrier on the primary transfer belt. The fixing unit is provided above the secondary transfer unit.

15 Claims, 6 Drawing Sheets

FOREIGN PATENT DOCUMENTS

| | | |
|---|---|---|
| JP | A 8-63058 | 3/1996 |
| JP | A 8-314337 | 11/1996 |
| JP | A 10-24010 | 1/1998 |
| JP | A 11-119612 | 4/1999 |
| JP | A 11-202584 | 7/1999 |
| JP | A 2000-3121 | 1/2000 |
| JP | A 2001-22151 | 1/2001 |
| JP | A 2001-51522 | 2/2001 |
| JP | A-2001-134042 | 5/2001 |
| JP | A 2001-272833 | 10/2001 |
| JP | A 2001-312199 | 11/2001 |
| JP | A 2002-6697 | 1/2002 |
| JP | A 2002-72622 | 3/2002 |
| JP | A 2002-196635 | 7/2002 |

* cited by examiner

MULTICOLOR IMAGE FORMING APPARATUS AND IMAGE MAKING DEVICE

BACKGROUND OF THE INVENTION

1. Field of the Invention

The present invention relates to a multi color image forming apparatus such as a color laser printer and an image making device used therein.

2. Background Art

As a color laser printer based on the electrophotography, a so-called tandem color laser printer is well known in which the photosensitive drums are provided corresponding to the toners of yellow, magenta, cyan and black color. In such tandem color laser printer, a toner image for each color is formed on each photosensitive drum at the almost same time, so that the color image is formed at the almost same speed as the monochrome printer.

However, in the tandem color laser printer, the arrangement of fixing units for fixing a color toner image transferred onto the paper is needed to examine to reduce the size of apparatus.

That is, for example, in a direct transfer method in which a toner image for each color formed on each photosensitive drum is directly transferred onto the paper, the fixing units are usually provided sideways on the downstream side of a paper conveying belt that is opposed to the photosensitive drums disposed in parallel. However, there is the drawback that the image forming apparatus is very long in its parallel direction, because in addition to the length of the photosensitive drums disposed in parallel, the fixing units are provided in the parallel direction.

On the other hand, in an intermediate transfer method in which a toner image for each color formed on each photosensitive drum is once transferred onto an intermediate transfer belt to form a color toner image, and the color toner image formed on the intermediate transfer belt is transferred onto the paper by a secondary transfer roller, the photosensitive drums are disposed in parallel above the intermediate transfer belt in the almost horizontal direction, and the fixing units are disposed beneath the intermediate transfer belt, thereby preventing the image forming apparatus from being longer in the parallel direction of the photosensitive drums, as described in JP-A-2001-272833.

By the way, when the photosensitive member is charged by discharge of a charging wire in the charger of the multicolor image forming apparatus, a discharge product (mainly ozone) is produced. When this ozone adheres to the surface of the photosensitive member, an unevenness of charge occurs on the photosensitive member, and has some adverse influence such as an image drift on the image formed in the multicolor image forming apparatus.

Therefore, the multicolor image forming apparatus of this type may be provided with a duct for exhausting ozone to exhaust ozone from the side face of the multicolor image forming apparatus to the outside (e.g., refer to JP-A-2002-196635).

SUMMARY OF THE INVENTION

However, when the fixing units are disposed beneath the intermediate transfer belt, an exhaust heat or water vapor produced from the fixing units has influence on the intermediate transfer belt and the photosensitive drums, whereby there is a risk of causing an image formation failure, as described in JP-A-2001-272833.

Also, in the intermediate transfer method, if the paper and the intermediate transfer belt are closely located after the secondary transfer, or the distance from the secondary transfer roller to the fixing units is too long, the paper sticks to the intermediate transfer belt and is not peeled, after the secondary transfer, especially when the paper is very thin, resulting in a paper jam, unstable conveyance of paper, or a disordered image.

On the other hand, in the tandem multicolor image forming apparatus, the photosensitive members, the chargers, and exposing unit are provided corresponding to the number of colors (e.g., each four for four colors), whereby the apparatus is likely to become larger in size. Therefore, the configuration of the components of the multicolor image forming apparatus may be reexamined to reduce the size of the apparatus.

However, when the duct for exhausting ozone is provided within the apparatus as conventionally, a space for disposing this duct is required, whereby it is difficult to make the apparatus smaller.

An image forming apparatus for forming the high quality image is disclosed herein, in which the apparatus is made smaller in size and the transfer medium is stably conveyed.

A multicolor image forming apparatus is also disclosed herein, which is capable of exhausting ozone produced within the multicolor image forming apparatus more efficiently by providing the ventilating duct without increasing the size of the multicolor image forming apparatus.

According to an aspect of the invention, an image forming apparatus, includes: a plurality of image carriers each carrying a developer image formed by developing an electrostatic latent image with a developer and each provided for each color; a primary transfer belt opposed to the plurality of image carriers and configured to carry a multicolor developer image formed by transferring the developer image for each color that is carried on the image carrier; a secondary transfer unit opposed to the primary transfer belt and configured to transfer the multicolor developer image carried on the primary transfer belt onto a transfer medium; and a fixing unit configured to fix the multicolor developer image transferred by the secondary transfer unit on the transfer medium. The primary transfer belt is provided along a substantial vertical direction. The secondary transfer unit is provided on the opposite side of the image carrier on the primary transfer belt. The fixing unit is provided above the secondary transfer unit.

With such a configuration, the secondary transfer unit is disposed on the opposite side of each image carrier on the primary transfer belt, and the fixing unit is provided above the secondary transfer unit, whereby the apparatus is reduced and the installation area is saved, so that exhaust heat or water vapor produced from the fixing unit has less influence on the primary transfer belt or each image carrier. Since the secondary transfer unit and the fixing unit are disposed in close proximity, the transfer medium is stably conveyed to form the high quality image.

According to another aspect of the invention, an image forming apparatus includes: a plurality of image carriers each configured to carry a developer image formed by developing an electrostatic latent image with a developer and each provided for each color; a primary transfer belt opposed to the plurality of image carriers and configured to carry a multicolor developer image formed by transferring the developer image for each color that is carried on the image carrier; and a secondary transfer unit opposed to the primary transfer belt and configured to transfer the multicolor developer image carried on the primary transfer belt onto a transfer medium. The primary transfer belt moves on a path having a concave portion disposed downstream of an opposing portion where the primary transfer belt opposes to the secondary transfer unit. The concave portion is provided with a cleaning member that cleans the primary transfer belt.

With such a configuration, owing to the concave portion, the angle made between a direction in which the transfer medium after the secondary transfer goes and a direction in which the downstream portion of the primary transfer belt from the secondary transfer position goes can be increased. Therefore, the transfer medium is unlikely to twine around the primary transfer belt after the secondary transfer. As a result, a paper jam is prevent from occurring due to adherence of the transfer medium after the secondary transfer to the primary transfer belt, whereby the transfer medium is stably conveyed to form the high quality image. Also, since the cleaning member is disposed in the concave portion, the cleaning member of the primary transfer belt also serves as the member for forming the path of the primary transfer belt in the concave portion. Therefore, the number of parts is reduced, and the configuration is simplified, so that the concave portion is securely formed in the primary transfer belt.

According to another aspect of the invention, a multicolor image forming apparatus includes: a plurality of image making units disposed in parallel in a substantial vertical direction, the image making units being provided for each color, each image making unit including: a photosensitive member having a surface; a charger that uniformly charges the surface of the photosensitive member; and a visible image forming unit that forms a visible image by supplying a developer of a predetermined color on an electrostatic latent image that is formed when the surface of the photosensitive member charged by the charger is exposed to light; a transfer unit that transfers a developer of the visible image formed on the surface of the photosensitive member onto a recording medium; a fixing unit that fixes on the recording medium the developer transferred onto the recording medium; and an exhaust air passage portion including an exhaust air path having an exhaust port provided on an upper face of the multicolor image forming apparatus, the exhaust air path configured to lead upwards air passing in the vicinity of the charger and to exhaust the air through the exhaust port.

That is, with this configuration, since the air is passed near the charger disposed in parallel in the almost vertical direction, the exhaust air passage portion has a shaped portion extending in the almost vertical direction, so that the air through this shaped portion is exhausted through the exhaust port provided on the upper face of the apparatus.

Also, the warm air heated in the inside of the apparatus ascends in this exhaust air passage portion, causing the pressure under this warm air to be lower and causing the lower air to move upwards, giving rise to an ascending current (a so-called funnel effect).

According to another aspect of the invention, a multicolor image forming apparatus for forming a multicolor image on the recording medium, includes: a mainframe;

a plurality of image making unit disposed in parallel in a substantial vertical direction to form a multicolor image on the recording medium, the image making unit being provided for each color, each image making unit including: a photosensitive member having a surface; a charger that uniformly charges the surface of the photosensitive member; and a visible image forming unit that forms a visible image by supplying a developer of a predetermined color on an electrostatic latent image that is formed when the surface of the photosensitive member charged by the charger is exposed to light; a transverse exhaust air passage portion including a transverse exhaust air path disposed in the neighborhood of the charger to circulate air around the charger for ventilation; a longitudinal exhaust air passage portion including a longitudinal exhaust air path configured to lead air passing through the transverse exhaust air path and to exhaust the air outside, the longitudinal exhaust air passage portion being connected to the transverse exhaust air passage portion; and a unit loadable in and unloadable from the mainframe. The transverse exhaust air passage portion is included in the unit. The unit supports at least one of the plurality of the image making unit.

Consequently, in the multicolor image forming apparatus, a part of the transverse exhaust air passage portion is shared with the unit, the amount of material composing the apparatus is smaller than when the unit and the transverse exhaust air passage portion are provided separately, whereby the apparatus is reduced. Therefore, the interval between the transverse exhaust air passage portions disposed is narrowed, the length of the longitudinal exhaust air passage portion is shorter, and the resistance to the air flow is reduced, whereby the exhaust efficiency is improved.

According to another aspect of the invention, an image making device for use in a multicolor image forming apparatus, wherein the multicolor image forming apparatus includes: a mainframe; and a plurality of image making unit disposed in parallel in a substantial vertical direction to form a multicolor image on the recording medium, the image making unit being provided for each color, each image making unit including: a photosensitive member having a surface; a charger that uniformly charges the surface of the photosensitive member; and a visible image forming unit that forms a visible image by supplying a developer of a predetermined color on an electrostatic latent image that is formed when the surface of the photosensitive member charged by the charger is exposed to light; the image making device includes: a transverse exhaust air passage portion including a transverse exhaust air path to be disposed in the neighborhood of the charger to circulate air around the charger for ventilation. The image making device supports at least one of the plurality of image making units. The image making device is loadable in and unloadable from the mainframe.

Consequently, in the image making device, the transverse exhaust air passage portion does not exist on the way of mounting or demounting the image making unit, and the space for avoiding the transverse exhaust air passage portion is not needed, whereby the multicolor image forming apparatus is reduced. Also, there is no need for providing the complicated way of mounting or demounting the image making unit to avoid the transverse exhaust air passage portion, thereby facilitating the exchange work.

BRIEF DESCRIPTION OF THE DRAWINGS

The present invention may be more readily described with reference to the accompanying drawings.

DETAILED DESCRIPTION OF THE PREFERRED EMBODIMENTS

The First Preferred Embodiment

Figure 1:
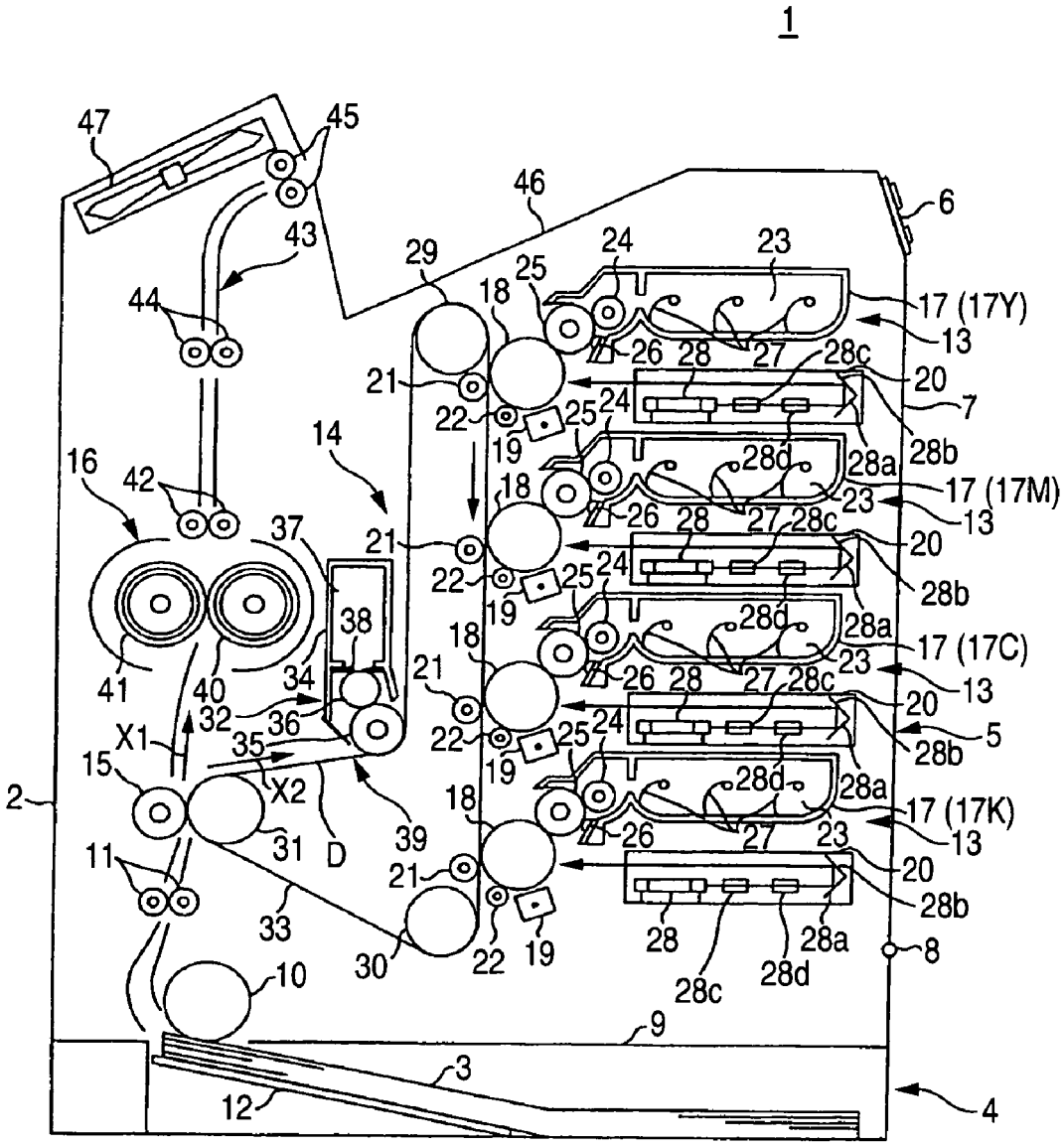
FIG. 1 is a side cross-sectional view of the essence showing a color laser printer as an image forming apparatus according to one embodiment of the present invention (in which a primary transfer belt is formed with a concave portion).

FIG. 1 is a side cross-sectional view showing the essence of a color laser printer as an image forming apparatus according to one embodiment of the present invention. In FIG. 1, this color laser printer 1 is the tandem color laser printer using an intermediate transfer method, comprising, within a main body casing 2, a feeder portion 4 for feeding the paper 3 as the transfer medium and an image forming portion 5 for forming the image on the supplied paper 3.

The main body casing 2 is provided with an operation panel 6 for operating this color laser printer 1 sideways at an upper portion on one side thereof, and a front cover 7 beneath the operation panel 6. This front cover 7 is borne rotatably via a hinge 8 on the main body casing 2 at its lower end, and is opened or closed from or on the main body casing 2 by rotation around the hinge 8 as the fulcrum.

In the following description, it is supposed that the side where the operation panel is provided is the fore side of this color laser printer 1 and the opposite side is the rear side.

An exhaust paper tray 46 is provided at an upper portion of the main body casing 2.

The feeder portion 4 includes, on the bottom portion within the main body casing 2, a paper feed tray 9 as a storage portion that can be mounted removably, a paper feed roller 10 functioning as a separation unit disposed above one end portion of the paper feed tray 9 (on the side where a secondary transfer roller 15 is disposed), and a resist roller 11 disposed above the paper feed roller 10.

Within the paper feed tray 9, a paper pressing plate 12 is provided the paper feed roller 10 having an end portion opposed to the paper feed roller 10 movable vertically, in which sheets of paper 3 are stacked on the paper pressing plate 12. The paper pressing plate 12 is urged from the back face by a spring, not shown. The paper 3 at the uppermost level on the paper pressing plate 12 is pressed toward the paper feed roller 10 by the spring and fed one by one by rotation of the paper feed roller 10.

The paper 3 fed by the paper feed roller 10 is fed to the resist roller 11, and resisted by the resist roller 11. After resist, the paper 3 is fed to a secondary transfer position of the image forming portion 5 (a contact portion between a primary transfer belt 33 and the secondary transfer roller 15).

The image forming portion 5 includes a process portion 13, an intermediate transfer mechanism portion 14, the secondary transfer roller 15 functioning as a secondary transfer unit, and a fixing unit 16 as a fixing unit.

The process portion 13 is provided for each of four colors, and includes a developing cartridge 17 as the developing unit, a photosensitive drum 18 as the image carrier, a Scorotron type charger 19, a scanner unit 20, a primary transfer roller 21, and a drum cleaning roller 22. Also, the process portions 13 are disposed in parallel in the almost vertical direction with a predetermined spacing apart from each other on the fore side of the main body casing 2.

Four developing cartridges 17 are yellow developing cartridge 17Y, magenta developing cartridge 17M, cyan developing cartridge 17C and black developing cartridge 17K, in which each developing cartridge is attached removably on the process portion 13 by opening or closing the front cover 7, and has a toner storage portion 23, a supply roller 24, a developing roller 25 and a film thickness regulating blade 26. Also, the developing cartridges 17 are disposed in parallel to overlap each other in the almost vertical direction with a predetermined spacing apart on the fore side of the main body casing 2 in the cross direction.

In the toner storage portion 23 for each developing cartridge 17, the toner is filled as the positively charged developer of nonmagnetic one component having the color of yellow for the yellow developing cartridge 17Y, magenta for the magenta developing cartridge 17M, cyan for the cyan developing cartridge 17C or black for the black developing cartridge 17K.

More specifically, the toner for each color is polymer toner having the shape of rough sphere produced by polymerization. The polymer toner contains, as a main component, a binding resin produced by copolymerizing styrene monomer, acrylic acid, or acrylic monomer such as alkyl (C1 to C4) acrylate or alkyl (C1 to C4) methacrylate by a well-known polymerization method of suspension polymerization, and a coloring agent, a charging control agent, and wax that are blended into the binding resin to form toner parent particles, with outside additive agents added to enhance the fluidity.

The coloring agent is provided for each color of yellow, magenta, cyan and black. Also, the charging control agent is a charging control resin, for example, which is produced by copolymerization of an ionic monomer having an ionic functional group such as ammonium salt, and a monomer copolymerizable with ionic monomer, such as styrene monomer or acryl monomer. Also, the outside additive agent may be the powder of metal oxide, such as silica, aluminum oxide, titanium oxide, strontium titanate, cerium oxide, or magnesium oxide, or the inorganic powder such as powder of carbide or powder of metal salt.

Such polymer toner, which is produced by polymerization, has uniform particle diameter in the shape of sphere, with quite excellent fluidity. Also, such polymer toner has an average particle diameter of 8 to 10 μm, and a glass transition point (Tg) from 60 to 65° C., in which the charging amount and polarity are controlled by the charging control agent.

And the toner within the toner storage portion 23 is discharged to the supply roller 24 through a toner supply port opened sideways of the tone storage portion 23 by agitation with an agitator 27 provided within the toner storage portion 23.

The supply roller 24 is rotatably provided sideways of the toner supply port, and the developing roller 25 is rotatably provided opposite to the supply roller 24. And the supply roller 24 and the developing roller 25 are contacted with each other in a state where the supply roller 24 is compressed to some extent.

The supply roller 24 has the roller of conductive sponge member covered around a metallic roller shaft.

The developing roller 25 has the roller of conductive elastic member of rubber material covered around a metallic roller shaft. More specifically, the developing roller 25 has a two layer structure composed of a roller portion of elastic body made of conductive urethane rubber, silicon rubber or EPDM rubber containing carbon particles, and a coat layer mainly composed of urethane rubber, urethane resin or polyimide resin that is covered on the surface of the roller portion.

Also, a development bias is applied to this developing roller 25 from a power source, not shown, at the time of development.

Also, the layer thickness regulating blade 26 is provided in the vicinity of the developing roller 25. This layer thickness regulating blade 26 has a pressing portion made of insulating silicon rubber in the shape of semi-circular section at the top end portion of a blade main body made from a metallic leaf spring, one end portion of the blade main body being borne by the developing cartridge 17 in the vicinity of the developing roller 25, in which the pressing portion is provided to exert a pressure on the developing roller 25 due to an elastic force of the blade main body.

And the toner discharged through the toner supply port is supplied to the developing roller 25 by rotation of the supply roller 24, and frictionally charged in positive polarity between the supply roller 24 and the developing roller 25. Furthermore, the toner supplied onto the developing roller 25 enters between the pressing portion of the layer thickness regulating blade 26 and the developing roller 25 along with the rotation of the developing roller 25, and carried on the developing roller 25 as a thin film of fixed thickness.

The photosensitive drum 18 is rotatably provided on the rear and obliquely lower side of the developing roller 25 in contact with the developing roller 25. This photosensitive drum 18 has a drum main body grounded, with its surface being formed of a photosensitive layer of an organic photosensitive member mainly composed of polycarbonate. Also, the photosensitive drums 18 are disposed to overlap each other in almost vertical direction, with a certain spacing apart from each other, at the almost central part of the main body casing 2 in the cross direction.

The Scorotron type charger 19 is provided beneath the photosensitive drum 18 to be out of contact with the photosensitive drum 18. This Scorotron type charger 19 is one for positive charging to produce a corona discharge from a charging wire made of tungsten or the like, the surface of photosensitive drum 18 being uniformly charged in positive polarity.

The scanner unit 20 is provided along the longitudinal direction of the developing cartridge 17 beneath the developing cartridge 17. Thereby, each developing unit 17 and each scanner unit 20 are disposed alternately in the almost vertical direction. This scanner unit 20 includes a laser radiating portion (not shown), a polygon mirror 28 driven for rotation, the reflecting mirrors 28*a* and 28*b*, and the lenses 28*c* and 28*d*. A laser beam radiated from the laser radiating portion and based on the image data is transmitted or reflected in the order of the polygon mirror 28, the lenses 28*c* and 28*d*, and the reflecting mirrors 28*a* and 28*b*, as indicated by the arrow, and applied on the surface of the photosensitive drum 18 by fast scanning.

And the toner for each color is exposed and developed in the following way. That is, first of all, the surface of the photosensitive drum 18 is uniformly charged positively by the Scorotron charger 19, along with the rotation of the photosensitive drum 18, and then exposed to light emitted from the scanner unit 20, so that an electrostatic latent image based on image data is formed. Then, when the positively charged toner carried on the developing roller 25 is opposed to and contacted with the photosensitive drum 18, along with the rotation of the developing roller 25, the toner is supplied to the electrostatic latent image formed on the surface of the photosensitive drum 18, namely, a part of the uniformly positively charged surface of the photosensitive drum 18 where there is a lower potential due to exposure from the scanner unit 20, and selectively carried and developed, thereby achieving the reverse development.

The primary transfer roller 21 is provided roughly opposite the photosensitive drum 18, with the primary transfer belt 33 sandwiched, on the downstream side of the developing roller 25 in the rotational direction of the photosensitive drum 18. This primary transfer roller 21 has the roller made of conductive rubber material covered around a metallic roller shaft, and is rotated following the driving of the photosensitive drum 18, in which a transfer bias is applied from a power source, not shown, at the time of primary transfer.

And the monochrome toner image carried on each photosensitive drum 18 is transferred onto the primary transfer belt 33, while the primary transfer belt 33 passes between the photosensitive drum 18 and the primary transfer roller 21.

A drum cleaner 22 is disposed between the primary transfer roller 21 and the Scorotron charger 19 in the rotational direction of the photosensitive drum 18 to withdraw the toner remaining after transfer.

The intermediate transfer mechanism portion 14 is disposed on the opposite side of each developing cartridge 17 in each photosensitive drum 18 within the main body casing 2, namely, on the rear side of each photosensitive drum 18, and includes a first roller 29, a second roller 30, a third roller 31, a cleaner 32 as the cleaning member, and the primary transfer belt 33.

The first roller 29 is disposed above the uppermost photosensitive drum 18 (photosensitive drum 18 corresponding to the yellow developing cartridge 17Y) and obliquely opposed to the uppermost photosensitive drum 18, with the primary transfer belt 33 sandwiched between them. Also, the second roller 30 is provided under the first roller 29 in the almost vertical direction, and disposed beneath the lowermost photosensitive drum 18 (photosensitive drum 18 corresponding to the black developing cartridge 17K) and obliquely opposed to the lowermost photosensitive drum 18, with the primary transfer belt 33 sandwiched between them. The third roller 31 is provided on the rear and obliquely lower side the first roller 29, and on the rear and obliquely upper side of the second roller 30, and disposed oppositely between the lowermost photosensitive drum 18 and its adjacent upper (second lowest) photosensitive drum 18 (photosensitive drum 18 corresponding to the cyan developing cartridge 17C) in the almost horizontal direction.

Thereby, the first roller 29, the second roller 30 and the third roller 31 are disposed in the shape of rough triangle projecting backward in a state where the third roller 31 is disposed under a central part of the line segment connecting the first roller 29 and the second roller 30 in the almost vertical direction.

The cleaner 32 is provided on the rear and obliquely lower side of the first roller 29, and on the fore and obliquely upper side of the third roller 31 on the line segment connecting the first roller 29 and the third roller 31, and disposed oppositely between the second lowest photosensitive drum 18 (photosensitive drum 18 corresponding to the cyan developing cartridge 17C) and its adjacent upper (third lowest) photosensitive drum 18 (photosensitive drum 18 corresponding to the magenta developing cartridge 17M) in the almost horizontal direction.

This cleaner 32 includes, within a cleaner casing 34, a cleaning roller 35, a withdrawal roller 36, a withdrawal box 37 and a scraper 38.

The cleaner casing 34 has the shape of a box having almost rectangular section that is opened on one side, and is disposed longitudinally along the almost vertical direction, with its opening portion directed downwards, at a position where the cleaner 32 is disposed. Thereby, an opening portion of the cleaner casing 34 on which the cleaning roller 35 is supported is disposed inside a rough triangle formed by the first roller 29, the second roller 30 and the third roller 31.

The cleaning roller 35 has the roller of elastic member made of conductive rubber material covered around a metallic roller shaft, and is disposed to face the path of the primary transfer belt 33 while being partially exposed out of the opening portion of the cleaner casing 34. This cleaning roller 35 is provided rotatably in the cleaner casing 34. At the time of cleaning, a cleaning bias is applied from a power source, not shown, to produce a potential difference between the primary transfer belt 33 and it.

The withdrawal roller 36 is composed of a metallic roller, and provided above the cleaning roller 35 within the cleaner casing 34 to be rotatable in the cleaner casing 34 in a state where it is opposed in contact to the cleaning roller 35. A withdrawal bias is applied to this withdrawal roller 36 from a power source, not shown, to produce a potential difference between the cleaning roller 35 and it at the time of cleaning.

The withdrawal box 37 is provided above the withdrawal roller 36 within the cleaner casing 34, and opened in a portion opposed to the withdrawal roller 36.

The scraper 38 is provided in an opening portion of the withdrawal box 37 in a state where it is pressed onto the withdrawal roller 36.

The primary transfer belt 33 is a conductive endless belt and wound around the outer circumference of the first roller 29, the second roller 30 and the third roller 31 with its inner side face being contact with the first roller 29 and the second roller 30 and the third roller 31, and its outer side face being contact with the cleaning roller 35.

Thereby, the path of the primary transfer belt 33 extends between the first roller 29 and the second roller 30 in the almost vertical direction to be oppositely contact with each photosensitive drum 18, extends between the second roller 30 and the third roller 31 to be rearwards and obliquely upwards from the second roller 30 to the third roller 31, and extends between the third roller 31 and the first roller 29 upwards from the third roller 31 to the first roller 29 to pass around the outer circumference of the cleaning roller 35 in a state where a concave portion 39 is inwardly depressed in the shape of rough V-character, because the cleaning roller 35 is disposed inside a rough triangle formed by the first roller 29, the second roller 30 and the third roller 31.

And in this intermediate transfer mechanism portion 14, the second roller 30 is driven, and followed by the first roller 29, the third roller 31 and the cleaning roller 35, so that the primary transfer belt 33 is moved around in the arrow direction (clockwise direction), in which the primary transfer belt 33 is moved from upper to lower in the region between the first roller 29 and the second roller 30 opposed to each photosensitive drum 18.

In this way, the outer side face of the primary transfer belt 33 is opposed to the photosensitive drums 18 in succession by the movement of the primary transfer belt 33 between the first roller 29 and the second roller 30, so that the toner image for each color formed on the photosensitive drum 18 is superposed successively on the primary transfer belt 33 to form a color toner image on the primary transfer belt 33.

That is, a yellow toner image formed on the photosensitive drum 18 by the yellow toner filled in the yellow developing cartridge 17Y is primarily transferred onto the primary transfer belt 33. Then, a magenta toner image formed on the photosensitive drum 18 by the magenta toner filled in the magenta developing cartridge 17M is primarily transferred onto the primary transfer belt 33 onto which the yellow toner image has been already transferred. And a cyan toner image formed by the cyan toner and a black toner image formed by the black toner are primarily transferred thereon in the same way. Thereby, a color toner image is formed on the primary transfer belt 33.

The secondary transfer roller 15 is rotatably provided at a position opposite the third roller 31 of the intermediate transfer mechanism portion 14 in the almost horizontal direction, with the paper 3 sandwiched, on the opposite side (i.e., rear side) of each photosensitive drum 18 on the primary transfer belt 33. The secondary transfer roller 15 is disposed to overlap the paper feed roller 10 and the resist roller 11 in the almost vertical direction. Therefore, the conveyance distance of the paper 3 laid on the paper feed tray 9 up to the secondary transfer roller 15 is short and roughly linear, whereby a paper jam is less likely to occur. Also, the secondary transfer roller 15 has the roller made of conductive rubber material covered around a metallic roller shaft, in which a transfer bias is applied from a power source, not shown, to the secondary transfer roller 15 at the time of transfer.

And the color toner image formed on the primary transfer belt 33 is transferred onto the paper 3 by applying a transfer bias to the secondary transfer roller 15, while the paper 3 is passed between the primary transfer belt 33 and the secondary transfer roller 15 at the secondary transfer position.

Also, the residual toner remaining on the primary transfer belt 33 after being transferred onto the paper 3 adheres to the cleaning roller 35 by a cleaning bias applied to the cleaning roller 35, when the residual toner is opposed to the cleaning roller 35. Thereafter, the residual toner adhering onto the cleaning roller 35 adheres to the withdrawal roller 36 by a withdrawal bias applied to the withdrawal roller 36, when the residual toner is opposed to the withdrawal roller 36, and is scraped by the scraper 38 and withdrawn into the withdrawal box 37.

In this color laser printer 1, the cleaner 32 is disposed on the path of the primary transfer belt 33. The concave portion 39 is formed in a downstream portion Din the movement direction of the primary transfer belt 33 from a contact portion with the secondary transfer roller 15 on the primary transfer belt 33, so that the angle made between a direction X1 where the paper 3 passed between the secondary transfer roller 15 and the primary transfer roller 33 goes and a direction X2 where the downstream portion D in the movement direction of the primary transfer belt 33 from the contact portion of the primary transfer belt 33 with the secondary transfer roller 15 goes is set at 45° or greater (75° in the embodiment of FIG. 1). The direction X2 where the downstream portion D in the movement direction of the primary transfer belt 33 from the contact portion of the primary transfer belt 33 with the secondary transfer roller 15 goes indicates the direction where the primary transfer belt 33 is moved between the third roller 31 and the cleaning roller 35.

The fixing unit 16 is disposed above the secondary transfer roller 15 to overlap the secondary transfer roller 15 and the downstream portion D in the movement direction of the primary transfer belt 33 from the contact portion of the primary transfer belt 33 with the secondary transfer roller 15 in the almost vertical direction, and to overlap the cleaner 32 between the uppermost level (i.e., the top portion of the first roller 29) and the lowermost level (i.e., the bottom portion of the second roller 30) of the primary transfer belt 33 in the almost vertical direction.

This fixing unit 16 includes a first heating roller 40, a second heating roller 41 opposed to the first heating roller 40 in the almost horizontal direction, with the paper 3 sandwiched, and a pair of conveying rollers 42 provided above the first heating roller 40 and the second heating roller 41.

The first heating roller 40 has a tungsten halogen lamp for heating within a cylindrical elementary tube made of metal such as aluminum, and is provided with an elastic layer on the outer circumferential face of the elementary tube. The second heating roller 41, like the primary heating roller 40, has a tungsten halogen lamp for heating within a cylindrical elementary tube made of metal such as aluminum, and is provided with an elastic layer on the outer circumferential face of the elementary tube to press the first heating roller 40.

And the paper 3 fed from the secondary transfer position to the fixing unit 16 has a color toner image thermally fixed by the first heating roller 40 and the second heating roller 41 while passing between them. Then, the paper 3 is conveyed to an exhaust paper path 43 by the pair of conveying rollers 42.

The exhaust paper path 43 is provided along the almost vertical direction in the main body casing 2, in which one pair of conveying rollers 44 are provided to face the exhaust paper path 43. A pair of paper exhaust rollers 45 are provided in a paper exhaust opening on the exhaust paper path 43.

This exhaust paper path 43 and the conveying path of the paper 3 from the paper feed roller 10 through the secondary transfer position to the fixing unit 16 are formed as a roughly straight path along the almost vertical direction.

And the paper 3 fed onto the exhaust paper path 43 by the conveying rollers 42 in the fixing unit 16 is conveyed between the paper exhaust rollers 45 by the conveying rollers 44, and then exhausted onto the exhaust paper tray 46 by the paper exhaust rollers 45.

In this color laser printer 1, a fan 47 is provided opposite to the exhaust paper path 43 at an upper portion of the main body casing 2. Heat and water vapor produced in the fixing unit 16 are expelled outside by the fan 47, thereby preventing occurrence of a faulty condition such as a great rise in temperature of the apparatus or dewing due to water vapor.

Since this color laser printer 1 is the so-called tandem type color laser printer in which the photosensitive drum 18 is provided for each color, the color image is formed by transferring the toner image formed for each color successively for each color at the roughly same speed as when the monochrome image is formed.

In this color laser printer 1, the secondary transfer roller 15 is disposed opposite the third roller 31, with the paper 3 sandwiched, on the opposite side of each photosensitive drum 18 on the primary transfer belt 33 in the almost horizontal direction, and the fixing unit 16 is disposed above the secondary transfer roller 15 to overlap the secondary transfer roller 15 and the downstream portion D in the movement direction of the primary transfer belt 33 from the contact portion of the primary transfer roller 33 with the secondary transfer roller 15 in the almost vertical direction. Therefore, exhaust heat or water vapor produced from the fixing unit 16 has less influence on the primary transfer belt 33 or each photosensitive drum 18, and owing to overlapping of each portion in the almost vertical direction, the apparatus is reduced in the almost horizontal direction and the installation area is saved. Also, the secondary transfer roller 15 and the fixing unit 16 are disposed in proximity, whereby the paper 3 is stably conveyed to form the high quality image.

Also, this color laser printer 1, the fixing unit 16 is disposed between the uppermost and lowermost levels of the primary transfer belt 33 in the almost vertical direction to overlap the cleaner 32, whereby the apparatus has a smaller size in the almost vertical direction.

Also, in this color laser printer 1, the cleaner 32 is disposed on the path of the primary transfer belt 33, and the concave portion 39 is formed in the downstream portion D in the movement direction of the primary transfer belt 33 from the contact portion of the primary transfer belt 33 with the secondary transfer roller 15, so that the angle made between direction X1 in which the paper 3 passed between the secondary transfer roller 15 and the primary transfer belt 33 goes and direction X2 in which the downstream portion D in the movement direction of the primary transfer belt 33 from the contact portion of the primary transfer belt 33 with the secondary transfer roller 15 is moved is set at 45° or greater. Therefore, after the secondary transfer, the paper 3 is unlikely to twine around the primary transfer belt 33, preventing a paper jam from occurring due to adherence of the paper 3 to the primary transfer belt 33 after the secondary transfer, whereby the paper 3 is stably conveyed to form the high quality image.

In this arrangement, the roller diameter of the third roller 31 is preferably set in a range from 20 mm to 30 mm, for example. If the roller diameter falls in this range, it is possible to effectively prevent the paper 3 from twining around the primary transfer belt 33.

In this way, the cleaner 32 is disposed by forming the concave portion 39 in the downstream portion D in the movement direction of the primary transfer belt 33 from the contact portion with the secondary transfer roller 15 on the path of the primary transfer belt 33, so that the angle between direction X1 in which the paper 3 goes after the secondary transfer and direction X2 in which the downstream portion D from the secondary transfer position on the primary transfer belt 33 goes is securely kept by the concave portion 39. Therefore, the paper 3 is conveyed more stably while preventing a paper jam from occurring. Also, since the cleaner 32 is disposed in a depressed portion above this concave portion 39, the apparatus is made smaller in the almost horizontal direction, making it possible to save more space of the installation area.

And the cleaning roller 35 of the cleaner 32 can serve as a cleaning member of the primary transfer belt 33 and a member for forming the path of the primary transfer belt 33 in the concave portion 39. Therefore, the number of parts is reduced, and the constitution is simplified, whereby the concave portion 39 is securely formed in the primary transfer belt 33.

Also, in this color laser printer 1, the photosensitive drum 18 and the developing cartridge 17 corresponding to it are provided to overlap each other in the almost vertical direction, whereby the apparatus is made smaller in the almost horizontal direction, making it possible to save more space of the installation area.

Also, in the embodiment as shown in FIG. 1, the cleaner 32 is disposed by forming the concave portion 39 in the downstream portion D in the movement direction of the primary transfer belt 33 from the contact portion with the secondary transfer roller 15 on the path of the primary transfer belt 33, so that the angle made between direction X1 in which the paper 3 goes after the secondary transfer and direction X2 in which the downstream portion D from the secondary transfer position on the primary transfer belt 33 goes is set at 45° or greater. However, in the embodiment as shown in FIG. 2, for example, the secondary transfer roller 15 may be provided above the central part of the primary transfer belt 33 in the almost vertical direction, so that the angle made between direction X1 in which paper 3 goes after the secondary transfer and direction X2 in which the downstream portion D from the secondary transfer position on the primary transfer belt 33 goes may be set at 45° or greater.

That is, in FIG. 2, the third roller 31 and the cleaner 32 of the intermediate transfer mechanism portion 14, the secondary transfer roller 15, and the fixing unit 16 are disposed in the following way. In FIG. 2, the apparatus constitution is almost the same as in the embodiment of FIG. 1, except for the constitution described below, and the duplicate description of the constitution is omitted.

Figure 2:
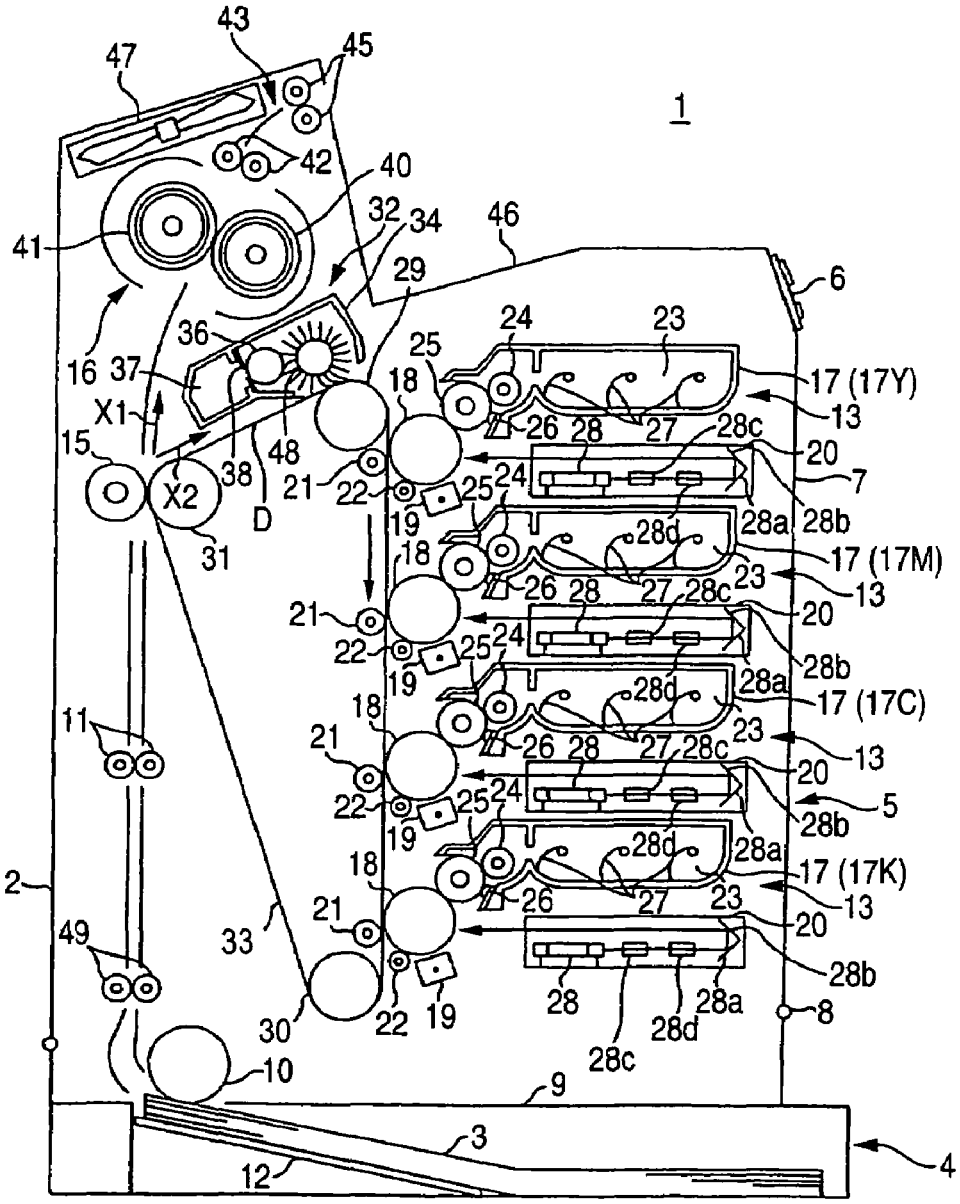
FIG. 2 is a side cross-sectional view of the essence showing a color laser printer as an image forming apparatus according to another embodiment of the invention (in which a secondary transfer roller is disposed above a central part of a primary transfer belt in almost vertical direction).

In FIG. 2, the third roller 31 is disposed on the rear and obliquely lower side of the first roller 29, and on the rear and obliquely upper side of the second roller 30, and opposed between the uppermost photosensitive drum 18 (photosensitive drum 18 corresponding to the yellow developing cartridge 17Y) and its adjacent lower (second uppermost) photosensitive drum 18 (photosensitive drum 18 corresponding to the magenta developing cartridge 17M) in the almost horizontal direction. Thereby, the first roller 29, the second roller 30 and the third roller 31 is disposed in the shape of a rough triangle projecting backwards in a state where the third roller 31 is disposed above the central part of the line segment connecting the first roller 29 and the second roller 30 in the almost vertical direction.

The cleaner 32 is provided at an upper portion between the first roller 29 and the third roller 31, and opposed to the uppermost photosensitive drum 18 in the almost horizontal direction. Also, the cleaner casing 34 is disposed around the position of the cleaner 32 to have its opening portion outside the rough triangle formed by the first roller 29, the second roller 30 and the third roller 31 and opposed to the first roller 29, with the longitudinal direction extending along the line segment connecting between the first roller 29 and the third roller 31. Also, this cleaner 32 is provided with a cleaning brush 48 within the cleaner casing 34, instead of the cleaning roller 35.

The cleaning brush 48 is formed radially with conductive brushes around a cylindrical main body, which are supported rotatably in the opening portion of the cleaner casing 34 in a state of being partially exposed downwards, and opposed to the primary roller 29, with the primary transfer belt 33 sandwiched. Also, a cleaning bias is applied from a power source, not shown to this cleaning brush 48 to have a potential difference between the primary transfer belt 33 and it at the time of cleaning in the same way as described above.

In the embodiment as shown in FIG. 2, the cleaner 32 is disposed outside the rough triangle formed by the first roller 29, the second roller 30 and the third roller 31, whereby the primary transfer belt 33 has its inner side face contact with the first roller 29, the second roller 30 and the third roller 31, and is wound in the shape of rough triangle without forming the concave portion 39.

Also, the secondary transfer roller 15 is disposed opposite to the third roller 31 of the intermediate transfer mechanism portion 14 in the almost horizontal direction, with the paper 3 sandwiched, and disposed above the central part of the line segment connecting the first roller 20 and the second roller 30 in the almost vertical direction.

Also, the fixing unit 16 is disposed above the secondary transfer roller 15 and the cleaner 32 to overlap the secondary transfer roller 15, the downstream portion D in the movement direction of the primary transfer belt 33 from the contact portion with the secondary transfer roller 15 on the primary transfer belt 33 and the cleaner 32 in the almost vertical direction, and disposed above the uppermost level of the primary transfer belt 33 in the almost horizontal direction.

In the embodiment as shown in FIG. 2, the secondary transfer roller 15 is disposed above the central part of the main body casing 2 in the vertical direction, whereby a pair of conveying rollers 49 for feeding the paper 3 from the paper feed roller 10 to the resist roller 11 are provided on the conveyance path leading from the paper feed roller 10 to the resist roller 11, though no conveying roller 44 is provided on the exhaust paper path 43.

And in the color laser printer 1 of the embodiment as shown in FIG. 2, the secondary transfer roller 15 is disposed opposite to the third roller 31, with the paper 3 sandwiched, on the opposite side of each photosensitive drum 18 on the primary transfer belt 33 in the almost horizontal direction, and the fixing unit 16 is disposed above the secondary transfer roller 15 to overlap the secondary transfer roller 15 and the downstream portion D in the movement direction of the primary transfer belt 33 from the contact portion with the secondary transfer roller 15 on the primary transfer belt 33 in the almost vertical direction. Therefore, exhaust heat or water vapor produced from the fixing unit 16 has less influence on the primary transfer belt 33 or the photosensitive drum 16, and the apparatus is made smaller in the almost horizontal direction and the installation area is saved by overlapping of each portion in the almost vertical direction. Also, the secondary transfer roller 15 and the fixing unit 16 are disposed in proximity, whereby the paper 3 is stably conveyed to form the high quality image.

Also, in the color laser printer 1 of the embodiment as shown in FIG. 2, the secondary transfer roller 15 is disposed above the central part of the line segment connecting the first roller 29 and the second roller 30 in the almost vertical direction, namely, above the central part of the primary transfer belt 33 in the almost vertical direction, whereby the secondary transfer roller 15 and the fixing unit 16 are disposed in closer proximity. Also, the angle made between direction X1 in which the paper 3 goes after the secondary transfer and direction X2 in which the downstream portion D goes from the secondary transfer position on the primary transfer belt 33 is increased (this angle is from 45° to 60° in this embodiment). Therefore, it is possible to prevent a paper jam from occurring due to adherence of the paper 3 to the primary transfer belt 33 after the secondary transfer, whereby the paper 3 is stably conveyed to form the higher quality image.

As described above, according to one aspect of the invention, the apparatus is reduced and the installation area is saved, so that exhaust heat or water vapor produced from the fixing unit has less influence on the primary transfer belt or each image carrier. Also, since the secondary transfer unit and the fixing unit are disposed in close proximity, the transfer medium is stably conveyed to form the high quality image.

According to another aspect of the invention, since the secondary transfer unit and the fixing unit are provided to overlap each other in the almost vertical direction, the installation area is further saved.

According to another aspect of the invention, since the primary transfer belt and the fixing unit are provided to overlap each other in the almost vertical direction, the installation area is further saved.

According to another aspect of the invention, a paper jam is prevented from occurring due to adherence of the transfer medium after the secondary transfer to the primary transfer belt, whereby the transfer medium is stably conveyed to form the high quality image.

According to another aspect of the invention, a paper jam is further prevented from occurring due to adherence of the transfer medium after the secondary transfer to the primary transfer belt, whereby the transfer medium is stably conveyed to form the higher quality image.

According to another aspect of the invention, a paper jam is prevented from occurring, and the transfer medium is further stably conveyed. Also, the apparatus is reduced in the almost horizontal direction, and the installation area is further saved.

According to another aspect of the invention, the apparatus is reduced in the almost vertical direction.

According to another aspect of the invention, the number of parts is reduced, and the configuration is simplified, so that the concave portion is securely formed in the primary transfer belt.

According to another aspect of the invention, a paper jam is prevented from occurring.

According to another aspect of the invention, a paper jam is prevented from occurring due to adherence of the transfer medium after the secondary transfer to the primary transfer belt, whereby the transfer medium is stably conveyed to form the high quality image. Also, the number of parts is reduced, and the constitution is simplified, so that the concave portion is securely formed in the primary transfer belt.

According to another aspect of the invention, the apparatus is reduced in the almost horizontal direction, and the installation area is saved.

The Second Preferred Embodiment

Figure 3:
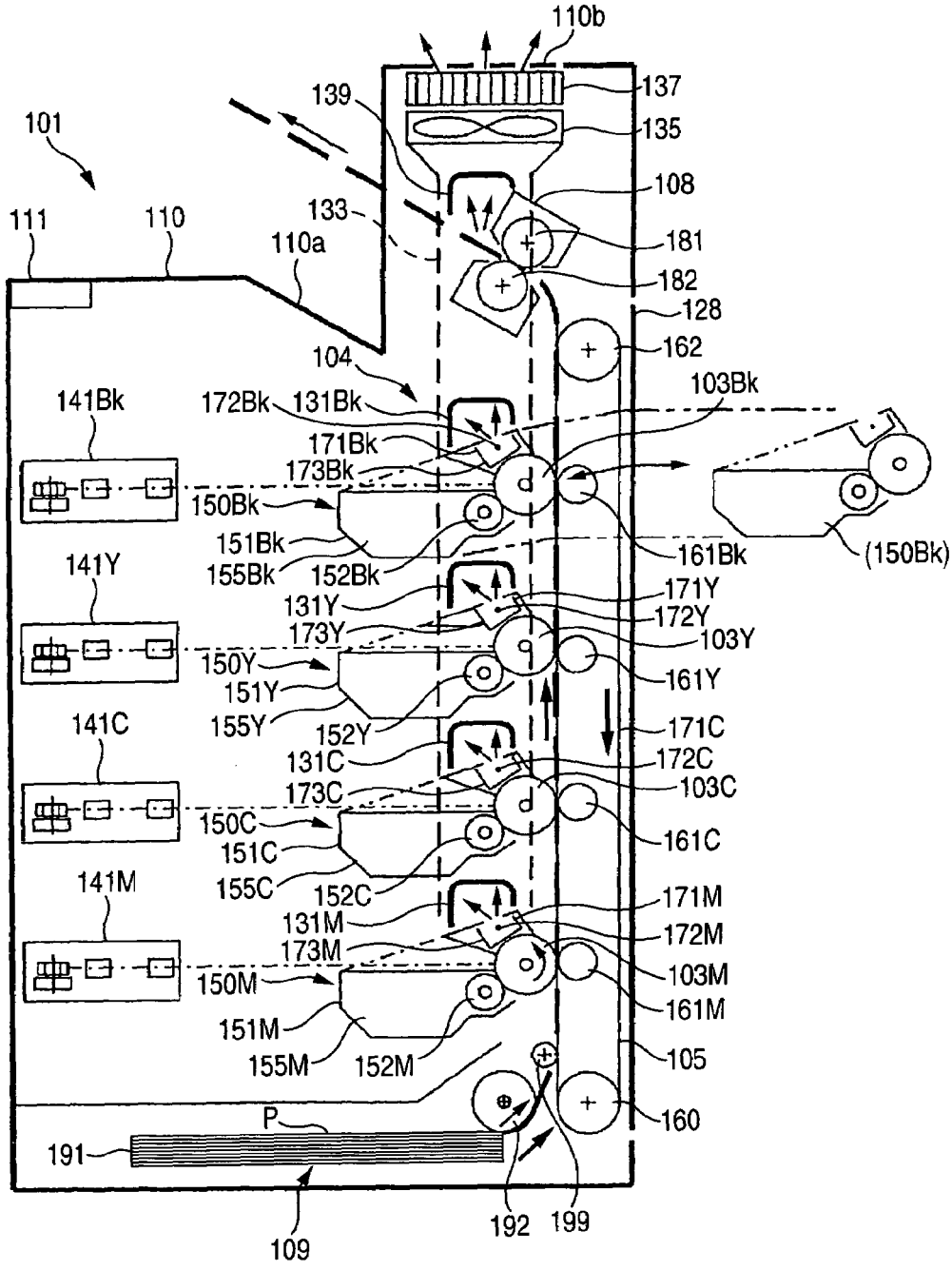
FIG. 3 is a schematic side cross-sectional view showing the overall configuration of a color laser printer according to a second embodiment of the present invention.
Figure 4:
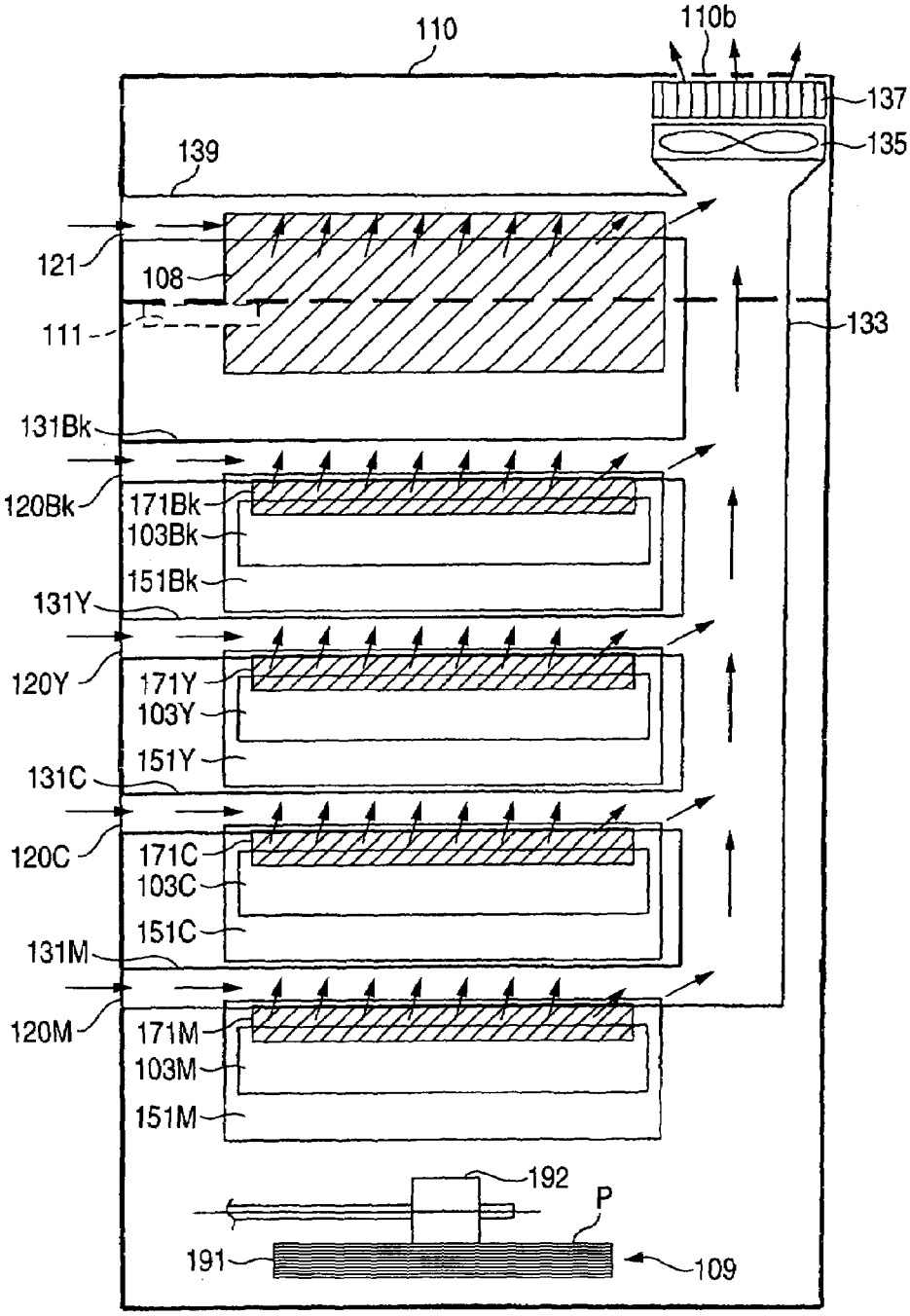
FIG. 4 is a schematic front view showing the overall configuration of the color laser printer according to the second embodiment of the invention.

A second embodiment of the present invention will be described below with reference to the accompanying drawings. FIG. 3 is a schematic cross-sectional view showing the internal configuration of a color laser printer 101 as a multicolor image forming apparatus according to the second embodiment of the invention, as seen from the side. Also, FIG. 4 is a schematic cross-sectional view thereof, as seen from the front.

The color laser printer 101 includes a visible image forming portion 104, a paper conveying belt 105, a fixing unit 108, a paper feed unit 109, and an exhaust paper tray 110*a*, in which a four color image corresponding to image data input externally is formed on the paper P as the recording medium, as shown in FIG. 3.

And the visible image forming portion 104 includes, for each visible image forming process with the toner for each color of magenta (M), cyan (C), yellow (Y) and black (Bk), a photosensitive drum 103M, 103C, 103Y or 103Bk as the photosensitive member, a charger 171M, 171C, 171Y or 171Bk, an exposing unit 141M, 141C, 141Y or 141Bk, and a developing unit 151M, 151C, 151Y or 151Bk. The exposing units 141M, 141C, 141Y and 141Bk and the developing units 151M, 151C, 151Y and 151Bk function as a visible image forming unit.

Each of the above components will be described in detail.

First of all, the photosensitive drum 103M, 103C, 103Y or 103Bk is composed of a roughly cylindrical member, and rotatably disposed at almost regular interval in the vertical direction. The roughly cylindrical member of the photosensitive drum 103M, 103C, 103Y or 103Bk has a positively chargeable photosensitive layer formed on an aluminum substrate, for example. And the aluminum substrate is grounded at the ground line in the color laser printer 101.

Also, the charger 171M, 171C, 171Y or 171Bk includes a charging wire 172M, 172C, 172Y or 172Bk opposite to the photosensitive drum 103M, 103C, 103Y or 103Bk and extending in its width direction, and a shield case 173M, 173C, 173Y or 173Bk for storing the charging wire 172M, 172C, 172Y or 172Bk, the shield case being opened on the side of the photosensitive drum 103M, 103C, 103Y or 103Bk and on its opposite side. The charger positively charges the surface of the photosensitive drum 103M, 103C, 103Y or 103Bk by applying a high voltage to the charging wire 172M, 172C, 172Y or 172Bk. Also, the shield case 173M, 173C, 173Y or 173Bk has a structure in which a grid is provided in an opening portion on the photosensitive drum 103M, 103C, 103Y or 103Bk, These chargers are the so-called Scorotron type charger in which a bias voltage is applied to this grid so that the surface of the photosensitive drum 103M, 103C, 103Y or 103Bk may be charged in the nearly same potential as the bias voltage.

Also, the exposing unit 141M, 141C, 141Y or 141Bk is disposed in the horizontal transverse direction to the rotation axis of the photosensitive drum 103M, 103C, 103Y or 103Bk, in which a laser beam corresponding to one color of image data input externally is emitted from a light source, and applied through an optical system onto the surface of the photosensitive drum 103M, 103C, 103Y or 103Bk by scanning over the specular surface of a polygon mirror driven and rotated by a polygon motor.

When the exposing unit 141M, 141C, 141Y or 141Bk applies a laser beam corresponding to the image data onto the surface of the photosensitive drum 103M, 103C, 103Y or 103Bk, an electrostatic latent image for each color is formed on the surface of the photosensitive drum 103M, 103C, 103Y or 103Bk.

The developing unit 151M, 151C, 151Y or 151Bk includes a developing unit case 155M, 155C, 155Y or 155Bk for storing the toner and a developing roller 152M, 152C, 152Y or 152Bk. And the developing unit 151M, 151C, 151Y or 151Bk charges the toner positively, supplies the charged toner as a uniform thin film to the developing roller 152M, 152C, 152Y or 152Bk, and develops an electrostatic latent image of positive polarity (positively charged) formed on the photosensitive drum 103M, 103C, 103Y or 103Bk with the positively charged toner at a contact part between the developing roller 152M, 152C, 152Y or 152Bk and the photosensitive drum 103M, 103C, 103Y or 103Bk to form the image by the reversal method.

The developing roller 152M, 152C, 152Y or 152Bk is formed in the cylindrical shape from conductive silicone rubber as a base substance, with a coat layer of resin or rubber material containing fluorine formed on the surface.

Also, the toner stored in the developing unit case 155M, 155C, 155Y or 155Bk is a positively charged, non-magnetic one component developer, in which the tone of magenta, cyan, yellow or black is stored in the developing unit case 155M, 155C, 155Y or 155Bk.

Also, the paper feed unit 109 is provided on the lowermost part of the apparatus, and includes a storage tray 191 for storing the sheets of paper P, and a pickup roller 192 for feeding out the paper P. And the pickup roller 192 picks up the paper P fed out of the paper feed unit 109 and feeds it between a conveying roller 199 and the paper conveying belt 105.

Also, the paper conveying belt 105 is wider than the photosensitive drum 103M, 103C, 103Y or 103Bk and made of a material having a viscosity not to cause the paper P to be slid, and looped between a drive roller 160 and a follower roller 162, as shown in FIG. 3. The transfer roller 161M, 161C, 161Y or 161Bk is provided near the position opposite the photosensitive drum 103M, 103C, 103Y or 103Bk. And the paper conveying belt 105 is moved, along with the rotation of the drive roller 160 and the follower roller 162, in such a way that the surface opposed to the photosensitive drum 103M, 103C, 103Y or 103Bk is passed from the lower to upper side in the vertical direction, as shown in FIG. 3. The paper P fed from the conveying roller 199 is conveyed in succession between the paper conveying belt 105 and the photosensitive drum 103M, 103C, 103Y or 103Bk, and passed to the fixing unit 108.

Also, the transfer roller 161M, 161C, 161Y or 161Bk, to which a predetermined voltage is applied, transfers the toner image formed on the photosensitive drum 103M, 103C, 103Y or 103Bk onto the paper P conveyed by the paper conveying belt 105.

Also, the fixing unit 108 is composed of a first heating roller 181 and a second heating roller 182, and fixes the toner images on the paper P by applying a heat and pressure on the paper P carrying the toner images of four colors, while the paper P is being sandwiched and conveyed by the first heating roller 181 and the second heating roller 182. Also, an exhaust heat duct 139 as an exhaust heat passage portion for releasing heat when the paper P is heated is provided.

Also, an upper face cover 110 is provided at the uppermost part of the apparatus, its part constituting an exhaust paper tray 11*a*. The exhaust paper tray 11*a* is provided on the exit side of the fixing unit 108 and receives the paper P expelled from the fixing unit 108.

Also, an operation portion 111 disposed with the buttons or indicators for setting the image forming conditions and indicating various states is provided on the front face of the upper face cover 110. Here, it is assumed that the operation portion 111 is disposed on the front face of the color laser printer 101.

In the color laser printer 101 with the above constitution according to this embodiment, the operation of forming the image on the paper P is as follows.

First of all, one paper P is supplied from the paper feed unit 109 by the pickup roller 192, and fed between the conveying roller 199 and the paper conveying belt 105.

Then, the surface of the photosensitive drum 103M, 103C, 103Y or 103Bk uniformly charged by the charger 171M, 171C, 171Y or 171Bk is exposed by the exposing unit 141M, 141C, 141Y or 141Bk, corresponding to the image data of magenta, cyan, yellow or black color externally input, so that the electrostatic latent image is formed. Then, the developing unit 151M, 151C, 151Y or 151Bk develops the electrostatic latent image by depositing the toner of magenta, cyan, yellow or black on the surface of the photosensitive drum 103M, 103C, 103Y or 103Bk. And the transfer roller 161M, 161C, 161Y or 161Bk transfers the toner image formed in this way onto the surface of the paper P conveyed by the paper conveying belt 105.

The toner image for each color is formed with a slight time difference according to the moving speed of the paper conveying belt 105 and the position of each photosensitive drum 103M, 103C, 103Y or 103Bk, and transferred and superposed onto the paper P conveyed by the paper conveying belt 105.

Then, the fixing unit 108 fixes the toner image for each of four colors formed on the paper P, and the paper P is expelled onto the exhaust paper tray 110*a*.

By the way, the photosensitive drum 103M, 103C, 103Y or 103Bk, the charger 171M, 171C, 171Y or 171Bk, the developing unit 151M, 151C, 151Y or 151Bk, and a cleaning roller 170M, 170Y, 170Y or 170Bk are made up as an image making unit 150M, 150C, 150Y or 150Bk held integrally and detachably on the apparatus for each color.

And a back panel 128 is inclined, together with the paper conveying belt 105 and the transfer roller 161M, 161C, 161Y or 161Bk, around a lower edge part of the back panel 128 as the fulcrum, in which the image making unit 150M, 150C, 150Y or 150Bk can be demounted from the plane where the back panel 128 is inclined, and exchanged.

On the other hand, when the charger 171M, 171C, 171Y or 171Bk charges the photosensitive drum 103M, 103C, 103Y or 103Bk in this embodiment, ozone is produced around the charger by discharge of the charging wire 172M, 172C, 172Y or 172Bk.

If ozone adheres to the photosensitive drum 103M, 103C, 103Y or 103Bk, the surface of the photosensitive drum 103M, 103C, 103Y or 103Bk is unevenly charged, having adverse influence on the electrostatic latent image formed thereon.

Therefore, to exhaust ozone outside, the color laser printer 101 is provided with a horizontal duct 131M, 131C, 131Y or 131Bk as the transverse exhaust air passage portion disposed over the charger 171M, 171C, 171Y or 171Bk and a vertical duct 133 as the longitudinal exhaust air passage portion connected to the horizontal ducts and extending in the almost vertical direction, as shown in FIG. 4.

The horizontal duct 131M, 131C, 131Y or 131Bk is composed of a member having the shape of roughly square barrel with an opening on one side, and disposed along the shield case 173M, 173C, 173Y or 173Bk so that its opening may be opposed to an opening portion on the upper side of the shield case 173M, 173C, 173Y or 173Bk. And the horizontal duct 131M, 131C, 131Y or 131Bk has its one end connected to a side opening portion 120M, 120C, 120Y or 120Bk provided on the side face of the apparatus and leads to the outside.

The shield case 173M, 173C, 173Y or 173Bk is formed with a large hole leading to the inside on the face opposed to the horizontal duct 131M, 131C, 131Y or 131Bk over the entire length.

Also, the vertical duct 133 is composed of a barrel member of rough square, and has one end connected to an upper face opening portion 110*b* provided on the upper face cover 110 to lead to the outside, with the other end sealed off. And a catching hole for the horizontal duct 131M, 131C, 131Y or 131Bk is formed on the side face of the vertical duct 133, and connected with one end of the horizontal duct 131M, 131C, 131Y or 131Bk that is not connected to the side opening portion 120M, 120C, 120Y or 120Bk.

Also, a catching hole for connecting one end of the exhaust heat duct 139 in the fixing unit 108 is formed on the side face of the vertical duct 133. The exhaust heat duct 139 has one end connected to the vertical duct 133, with the other end connected to a side opening portion 121 to lead to the outside.

Also, the upper face opening portion 10*b* is provided at the uppermost position of the vertical duct 133 extending straightly upwards, namely, rearward at the right edge part of the upper face cover 110, as seen from the front face.

Also, a fan 135 and an ozone filter 137 are provided at the end portion of the vertical duct 133 connected to the upper face opening portion 10*b*.

The fan 135 is attached to exhaust the air out of the vertical duct 133.

Also, the ozone filter 137 contains a material adsorbing ozone such as activated carbon, in which the air within the vertical duct 133 is passed through this material.

Herein, the air flows through the horizontal duct 131M, 131C, 131Y or 131Bk and the vertical duct 133 in the following way as indicated by the arrow in FIG. 4.

First of all, the fan 135 is rotated to exhaust the air out of the vertical duct 133, so that the air within the vertical duct 133 flows to the fan 135 to make the inside of the vertical duct 133 at negative pressure. Therefore, the air within the horizontal duct 131M, 131C, 131Y or 131Bk and the exhaust heat duct 139 is sucked to flow into the vertical duct 133, so that the internal pressures of the horizontal duct 131M, 131C, 131Y or 131Bk and the exhaust heat duct 139 are decreased. Thereby, the air is flowed in from the side opening portion 120M, 120C, 120Y or 120Bk. In this way, the air flow from the side opening portion 120M, 120C, 120Y or 120Bk to the upper face opening portion 110*b* is formed.

Moreover, the air flowing through each duct absorbs heat within the color laser printer 101 and is warmed. Particularly, the air flowing through the exhaust heat duct 139 is warmed by the fixing unit 108. Because the warmed air is lighter, the air ascends within the vertical duct 133 after entering into the vertical duct 133. In this way, the pressure under the ascending air is decreased within the vertical duct 133, producing an ascending current to cause the unwarmed air to ascend together (a so-called funnel effect). And the air is sucked from the horizontal duct 131M, 131C, 131Y or 131Bk and the exhaust heat duct 139 due to a suction force of the fan 135 and a force of the ascending current.

At this time, due to the air flow through the horizontal duct 131M, 131C, 131Y or 131Bk, the air entering through the side opening 120M, 120C, 120Y or 120Bk flows into the shield case 173M, 173C, 173Y or 173Bk leading to the horizontal duct 131M, 131C, 131Y or 131Bl, so that the air inside the shield case 173M, 173C, 173Y or 173Bk flows into the vertical duct 133.

As described above, the color laser printer 101 according to the second embodiment includes the horizontal duct 131M, 131C, 131Y or 131Bk disposed near the charger 171M, 171C, 171Y or 171Bk, and the vertical duct 133, connecting to the horizontal duct 131M, 131C, 131Y or 131Bk, for conducting the air through the horizontal duct 131M, 131C, 131Y or 131Bk upwards and exhausting the air through the upper face opening portion 110*b*. Thereby, the air is flowed into the shield case 173M, 173C, 173Y or 173Bk due to the air flow into the horizontal duct 131M, 131C, 131Y or 131Bk, conducting ozone produced in the charging wire 172M, 172C, 172Y or 172Bk for the charger 171M, 171C, 171Y or 171Bk into an ozone filter 137 to adsorb ozone and exhaust the air outside.

Therefore, ozone produced in the charging wire 171M, 171C, 171Y or 171Bk is prevented from adhering to the photosensitive drum 103M, 103C, 103Y or 103Bk, causing an unevenness of charging and having influence on the formed image.

Also, owing to the funnel effect of the vertical duct 133, the exhaust efficiency is made better than only by suction of the fan 135.

Also, the exhaust heat duct 139 is connected to the vertical duct 133, the air warmed in the fixing unit 108 flows into the vertical duct 133, so that the ascending current owing to the funnel effect is increased to increased the exhaust efficiency.

Also, the upper face opening portion 110*b* is located closer to the rear at the right end part of the upper face cover 110 that overlaps substantially the end portion of the horizontal duct 131M, 131C, 131Y or 131Bk, whereby the vertical duct 133 is made almost straight to reduce the flow resistance, improving the exhaust efficiency.

Since the exhaust efficiency is enhanced in the above way, the horizontal duct 131M, 131C, 131Y or 131Bk is reduced, and the apparatus is made smaller. Also, by reducing the output of the fan 135, the energy saving and the silent operation are achieved.

Also, since the upper face opening portion 110*b* serving as the exhaust port is formed on the upper face cover 110 at the upper part of the color laser printer 101, the exhaust air is prevented from blowing off to the surrounding people. Also, since the upper face opening portion 110*b* on the upper face cover 110 is located away from the operation portion 111, the exhaust air is away from the person approaching the apparatus to make the operation, thereby preventing ozone odor of ozone contained in the exhaust air from giving a feeling of displeasure to the surrounding people of he apparatus. Particularly, the Scorotron system that is the charging system for the charger in the second embodiment has a relatively large amount of ozone, resulting in a significant effect of prevention.

Also, since the charging method of positive polarity in which ozone is difficult to occur is employed for the charger to charge electric charges, and the ozone filter 137 is provided on the upper face opening portion 110*b*, there is a smaller amount of ozone exhausted outside. Therefore, there is a great effect of preventing the odor of ozone from giving a feeling of displeasure.

The Third Preferred Embodiment

Figure 5:
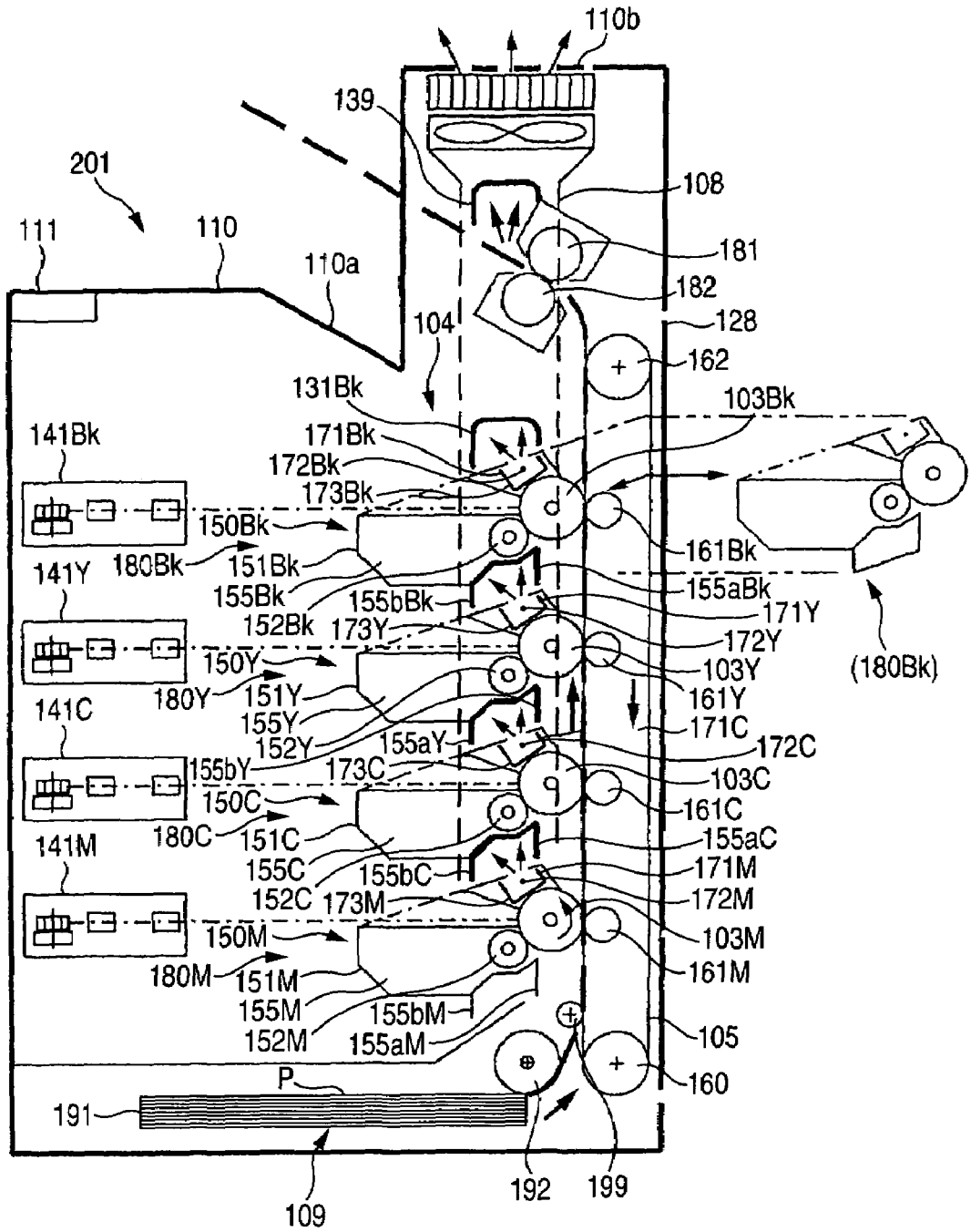
FIG. 5 is a schematic side cross-sectional view showing the overall configuration of a variation of a duct according to a third embodiment of the invention.
Figure 6:
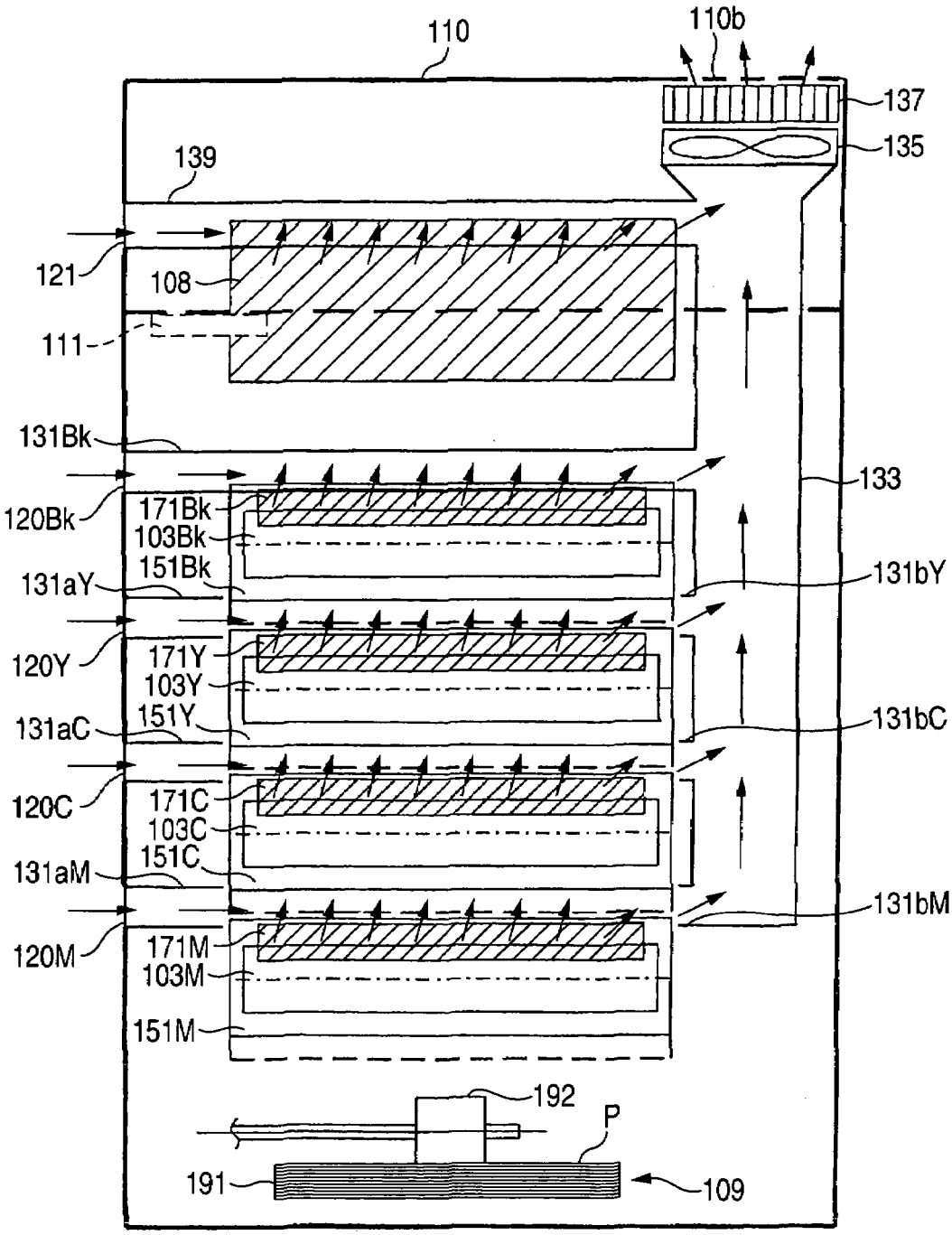
FIG. 6 is a schematic front view showing the overall configuration of the variation of the duct according to the third embodiment of the invention.

A third embodiment of the invention will be described below with reference to the drawings. FIG. 5 is a schematic cross-sectional view showing the internal constitution of the color laser printer 201 according to the third embodiment of the invention, as seen from the side. FIG. 6 is a schematic cross-sectional view, as seen from the front.

The color laser printer 201 employs the image making units 180C, 180Y and 180Bk comprising the structure of horizontal ducts 131M, 131C and 131Y, instead of the image making units 150C, 150Y and 150Bk in the color laser printer 101 of the second embodiment. And other constitutions and functions are the same as those of the color laser printer 101 of the second embodiment.

That is, the image making unit 180C, 180Y or 180Bk is formed with a first plate plane 155*a*C, 155*a*Y or 155*a*Bk and a second plate plane 155*b*C, 155*b*Y or 155*b*Bk, which is a plate member of rough rectangle in the vertical direction, on the bottom face of the developing unit case 155C, 155Y or 155Bk, so as to form three plate planes having the shape of rough U-character serving as the horizontal duct 131M, 131C or 131Y for the charger 171M, 171C or 171Y that is located directly below and opposed, when mounted on the color laser printer 201, in addition to the constitution of the image making units 150C, 150Y and 150Bk, as shown in FIG. 5. The plate plane in the horizontal direction is directly the bottom face of the developing unit case 155M, 155C or 155Bk. Also, the image making unit 180M has no charger directly below, and may be directly the constitution of the image making unit 150M, but is formed with the first plate plane 155*a*M and the second plate plane 155*b*M in consideration of the productivity in the same way as the other image making units.

Also, the color laser printer 201 is formed with a first coupling duct 131*a*M, 131*a*C and 131*a*Y and a second coupling duct 131*b*M, 131*b*C and 131*b*Y in accordance with the first plate plane 155*a*C, 155*a*Y and 155*a*Bk and the second plate plane 155*b*C, 155*b*Y and 155*b*Bk formed on the image making unit 180C, 180Y and 180Bk, and the sectional shape of the bottom face for the developing unit case 155C, 155Y and 155Bk, as shown in FIG. 6. The first coupling duct 131*a*M, 131*a*C or 131*a*Y is provided between the side opening portion 120M, 120C or 120Y and the image making unit 180C, 180Y or 180Bk. Also, the second coupling duct 131*b*M, 131*b*C or 131*b*Y is provided between the image making unit 180C, 180Y or 180Bk and the vertical duct 133. And a packing (not shown) is provided at the junction between the first and second coupling ducts and the image making unit 180C, 180Y or 180Bk to have no interstice in the color laser printer 201. The horizontal duct 131Bk is installed within the apparatus in the same way as in the second embodiment.

In the color laser printer 201 with the above constitution according to the third embodiment, the image making unit 180M, 180C, 180Y and 180Bk is mounted at closer interval, whereby the color laser printer 201 can be lower in height than the color laser printer 101.

That is, in the color laser printer 101 of the second embodiment, to allow the image making unit 150M, 150C, 150Y or 150Bk to be mounted or demounted across the horizontal duct 131M, 131C, 131Y or 131Bk, the horizontal duct 131M, 131C, 131Y or 131Bk is disposed at wider interval than the thickness of the image making unit 150M, 150C, 150Y or 150Bk, and accordingly the image making unit 150M, 150C, 150Y or 150Bk is disposed at wider interval than the thickness of the image making unit 150M, 150C, 150Y or 150Bk.

However, in the color laser printer 201 of the third embodiment, there is no interference problem in mounting or demounting the image making unit 180M, 180C, 180Y or 180Bk, because the horizontal ducts 131M, 131C and 131Y do not exist on the path for mounting or demounting, whereby the image making unit 180M, 180C, 180Y or 180Bk is disposed at closer interval. Therefore, the total height of the apparatus is decreased.

Also, the length of the vertical duct 133 is made shorter by decreasing the total height of the apparatus, making it possible to improve the exhaust efficiency.

Though the second and third embodiments have been described above, this invention is not limited to the specific embodiment as above, but maybe practiced in various other forms.

For example, in the second and third embodiments, the fan 135 is employed for compulsory ventilation, but the natural ventilation may be made without using the fan 135. Also, the exhaust heat duct 139 passing through the fixing unit 108 may not be connected to the vertical duct 133, or the ozone filter 137 may not be mounted. In this case, the ventilation occurs upwards owing to the funnel effect with the air warmed by the fixing unit 108. Also, the charger 171M, 171C, 171Y or 171Bk may be other than the Scorotron type, or may charge the photosensitive drum 103M, 103C, 103Y or 103Bk in negative polarity.

Also, though in the third embodiment, the air is exhausted upwards through the upper face opening portion 110*b* of the upper face cover 110 from the vertical duct 133 to validate the funnel effect, the air maybe exhausted from the side face by providing the opening portion on the side face without expecting the funnel effect.

Also, in the second and third embodiments, the image is formed on the paper P conveyed from the paper conveying belt 105 by directly transferring the toner image from the photosensitive drum 103M, 103C, 103Y and 103Bk onto the paper P. However, the intermediate transfer belt may be provided for once transferring the toner image for each of four colors formed on the photosensitive drum 103M, 103C, 103Y and 103Bk onto the intermediate transfer belt, and then transferring the toner images transferred on the intermediate transfer belt onto the paper P at a pressure contact position between the secondary transfer roller and the intermediate transfer belt by which the paper P is passed.

What is claimed is:

1. An image forming apparatus, comprising:

a plurality of image carriers each carrying a developer image formed by developing an electrostatic latent image with a developer and each provided for each color;

a primary transfer belt opposed to the plurality of image carriers and configured to carry a multicolor developer image formed by transferring the developer image for each color that is carried on the image carrier;

a secondary transfer unit opposed to the primary transfer belt and configured to transfer the multicolor developer image carried on the primary transfer belt onto a transfer medium;

a fixing unit configured to fix the multicolor developer image transferred by the secondary transfer unit on the transfer medium; and a fan disposed above the fixing unit, wherein the primary transfer belt is provided along a substantial vertical direction;

the secondary transfer unit is provided on the opposite side of the image carrier on the primary transfer belt and above a central part of the primary transfer belt in a substantial vertical direction: and the fixing unit is provided above the secondary transfer unit.

2. The image forming apparatus according to claim 1, wherein the secondary transfer unit and the fixing unit overlap with each other in a substantial vertical direction.

3. The image forming apparatus according to claim 1, wherein the primary transfer belt and the fixing unit overlap with each other in a substantial vertical direction.

4. The image forming apparatus according to claim 1, wherein an angle made between a direction in which the transfer medium passed between the secondary transfer unit and the primary transfer belt and a direction in which a downstream portion of the primary transfer belt in a movement direction from an opposed portion of the primary transfer belt to the secondary transfer unit is about 45° or more.

5. The image forming apparatus according to claim 1, wherein the primary transfer belt moves in a path having a concave portion disposed downstream of an opposing portion where the primary transfer belt opposes to the secondary transfer unit.

6. The image forming apparatus according to claim 5, wherein the fixing unit is provided between an uppermost level and a lowermost level of the primary transfer belt in the vertical direction.

7. The image forming apparatus according to claim 5, wherein the concave portion is provided with a cleaning member that cleans the primary transfer belt.

8. The image forming apparatus according to claim 1, further comprising:

a storage portion that stores stacked sheets of transfer medium; and a separation unit configured to separate one sheet of the transfer medium from the storage portion;

wherein the separation unit is disposed on the side of the secondary transfer unit.

9. The image forming apparatus according to claim 8, further comprising a plurality of conveying rollers provided between the separation unit and the secondary transfer unit.

10. The image forming apparatus according to claim 1, further comprising a plurality of developing units each provided correspondingly to each of the image carriers for each color;

wherein the image carrier for each color and the developing unit for each color overlap with each other in a substantial vertical direction.

11. The image forming apparatus according to claim 1, wherein the fan and the fixing unit overlap with each other in a substantially vertical direction.

12. The image forming apparatus according to claim 1, further comprising a first roller, a second roller, and a third roller, wherein the primary transfer belt winds around outer circumferences of the first roller, the second roller, and the third roller to form a substantially triangular wounding shape.

13. The image forming apparatus according to claim 12, further comprising a cleaner disposed on a path of the primary transfer belt.

14. The image forming apparatus according to claim 12, wherein the third roller is disposed opposite the secondary transfer unit and the central part of the primary transfer belt is defined by a line segment connecting the first roller and the second roller.

15. The image forming apparatus according to claim 1, further comprising an accommodation portion that is provided above the discharge tray and accommodates the fixing unit.

* * * * *